US007574759B2

(12) United States Patent
Wilson et al.

(10) Patent No.: US 7,574,759 B2
(45) Date of Patent: Aug. 18, 2009

(54) FACE CRADLE INSERT DEVICE

(76) Inventors: Kimberly Forness Wilson, 401 Park Dr., Grand Forks, ND (US) 58201; Bob K. Steers, 1915 21st Ave. South, Grand Forks, ND (US) 58201

( * ) Notice: Subject to any disclaimer, the term of this patent is extended or adjusted under 35 U.S.C. 154(b) by 221 days.

(21) Appl. No.: 11/466,482

(22) Filed: Aug. 23, 2006

(65) Prior Publication Data

US 2008/0047069 A1 Feb. 28, 2008

(51) Int. Cl.
*A47G 9/10* (2006.01)
*A47C 20/00* (2006.01)

(52) U.S. Cl. ..... 5/636; 5/638; 5/622

(58) Field of Classification Search ..... 5/638, 5/636, 640, 632, 621, 622, 661
See application file for complete search history.

(56) References Cited

U.S. PATENT DOCUMENTS 3,211,146 A * 10/1965 Rodelli ..... 604/303
3,337,883 A * 8/1967 Allison ..... 5/638
3,366,106 A * 1/1968 Yao et al. ..... 606/204.35
3,828,377 A 8/1974 Fary, Sr.
4,333,638 A 6/1982 Gillotti
4,504,050 A * 3/1985 Osborne ..... 5/637
4,746,167 A 5/1988 Palmer et al.
4,752,064 A * 6/1988 Voss ..... 5/638
D298,992 S * 12/1988 Voss ..... D6/601
4,840,362 A 6/1989 Bremer et al.
5,165,137 A * 11/1992 Amrein et al. ..... 5/640
5,177,823 A 1/1993 Riach
D337,914 S * 8/1993 McDonald ..... D6/601
5,347,668 A 9/1994 Manning
5,613,501 A * 3/1997 Michelson ..... 5/637
5,848,448 A * 12/1998 Boyd ..... 5/636
D404,237 S * 1/1999 Boyd ..... D6/601
5,921,696 A 7/1999 Gillotti
5,970,546 A 10/1999 Danis
6,042,184 A * 3/2000 Kofoed ..... 297/391
6,112,333 A * 9/2000 Mazzei ..... 2/410
6,148,460 A 11/2000 Fried et al.
6,151,734 A 11/2000 Lawrie
6,154,903 A * 12/2000 Wai-Chung ..... 5/632
D456,516 S * 4/2002 Cheshaek et al. ..... D24/183
6,397,414 B1 6/2002 Lloyd
6,490,737 B1 * 12/2002 Mazzei et al. ..... 2/410
6,561,194 B2 * 5/2003 Michelson ..... 128/845
6,637,058 B1 * 10/2003 Lamb ..... 5/638
6,684,431 B2 * 2/2004 Splane, Jr. ..... 5/657
6,745,418 B1 6/2004 Turner, Jr.
6,842,924 B1 * 1/2005 Walters ..... 5/637

(Continued)

OTHER PUBLICATIONS

"Supply Price List 2005," The Massage Store pamphlet.

(Continued)

*Primary Examiner*—Robert G Santos

(57) ABSTRACT

A face cradle insert device for providing extra support to the neck and head area of a person during a massage. The face cradle insert device includes a pad and a receiver opening, wherein the pad is removably attached to a face cradle of a massage table. The receiver opening extends through the pad and includes a first portion and a second portion extending from the first portion. The first portion and the second portion are comprised of a configuration to comfortably fit the face of a user.

19 Claims, 7 Drawing Sheets

U.S. PATENT DOCUMENTS

| | | | | |
|---|---|---|---|---|
| 6,922,860 | B2 | 8/2005 | Cuddy | |
| 6,934,988 | B1 | 8/2005 | Wetzler et al. | |
| 7,080,420 | B2 * | 7/2006 | Damron | 5/640 |
| 2002/0096929 | A1 | 7/2002 | Showerman | |
| 2003/0084513 | A1 * | 5/2003 | Splane, Jr. | 5/657 |
| 2004/0172064 | A1 | 9/2004 | MacDonald | |
| 2006/0005313 | A1 | 1/2006 | Fluellen | |
| 2006/0253985 | A1 * | 11/2006 | Skripps | 5/622 |
| 2008/0047069 | A1 * | 2/2008 | Wilson et al. | 5/622 |
| 2008/0047070 | A1 * | 2/2008 | Forness Wilson et al. | 5/636 |

OTHER PUBLICATIONS

Reynolds, personal letter to Kim Forness Wilson, Nov. 30, 2007, unpublished.

Colorado Healing Arts Products. Fleece Facehole Cushion. photograph of product, picture taken Jan. 8, 2008.

Massage Warehouse, Face Hole Cushion, website printout of <http://www.massagewarehouse.co.nz/store/product.php-?productid=16262&cat=267&page=1>, date unknown, New Zealand.

http://www.amazon.com/exec/obidos/ASIN/B0002F9YFU/yahoo-hpc06-20/ref=nosim.

http://www.amedicalmall.com/donutcushion.html.

http://pregnancybackache.alimed-heel-pain.com/cl1115.html.

Patent Cooperation Treaty, International Search Report & Written Opinion of International Searching Authority, Aug. 5, 2008, PCT/US07/76470, 10 pages.

* cited by examiner

FACE CRADLE INSERT DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to massage tables and more specifically it relates to a face cradle insert device for providing extra support to the head and neck area of a person during a massage.

2. Description of the Related Art

Any discussion of the prior art throughout the specification should in no way be considered as an admission that such prior art is widely known or forms part of common general knowledge in the field.

Massage tables have been in use for years. Typically, massage tables are used in commercial massaging environments. A patient generally lies down on their stomach or back on the massage table. The massage tables are generally comprised of a foam or other cushiony material and usually include a face cradle. The face cradle generally extends from one end of the massage table and is comprised of a horseshoe structure. The face cradle allows the patient to stretch out on the massage table in a flat position.

Face cradles are generally manufactured to a single size. When a patient puts their face in the face cradle, the face cradle may prove to be uncomfortable for certain patients. The face cradle may be too small or just overall uncomfortable for individuals, wherein such individuals include but are not limited to smaller framed individuals and children.

In the past, people giving massages have generally placed a towel or other sheet material within the horseshoe of the face cradle to accommodate smaller framed patients. Placing a towel or other sheet over the face cradle can be uncomfortable for the patients and also does not generally provide an efficient place for the patient to put their head.

While these devices may be suitable for the particular purpose to which they address, they are not as suitable for providing extra support to the neck and head area of a person during a massage. Standard face cradles generally come in a single size and are not adjustable. Massages can be uncomfortable for smaller framed individuals when the face cradle is too large.

In these respects, the face cradle insert device according to the present invention substantially departs from the conventional concepts and designs of the prior art, and in so doing provides an apparatus primarily developed for the purpose of providing extra support to the neck and head area of a person during a massage.

BRIEF SUMMARY OF THE INVENTION

In view of the foregoing disadvantages inherent in the known types of massage tables now present in the prior art, the present invention provides a new face cradle insert device construction wherein the same can be utilized for providing extra support to the neck and head area of a person during a massage.

The general purpose of the present invention, which will be described subsequently in greater detail, is to provide a new face cradle insert device that has many of the advantages of the massage tables mentioned heretofore and many novel features that result in a new face cradle insert device which is not anticipated, rendered obvious, suggested, or even implied by any of the prior art massage tables, either alone or in any combination thereof.

To attain this, the present invention generally comprises a pad and a receiver opening, wherein the pad is removably attached to a face cradle of a massage table. The receiver opening extends through the pad and includes a first portion and a second portion extending from the first portion. The first portion and the second portion are comprised of a configuration to comfortably fit the face of a user.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a face cradle insert device that will overcome the shortcomings of the prior art devices.

A second object is to provide a face cradle insert device for providing extra support to the neck and head area of a person during a massage.

Another object is to provide a face cradle insert device that is contoured to fit a massage table face cradle.

An additional object is to provide a face cradle insert device that may be adaptable to different color choices and personalized covers.

A further object is to provide a face cradle insert device that increases the comfort for smaller framed patients/children during a massage.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
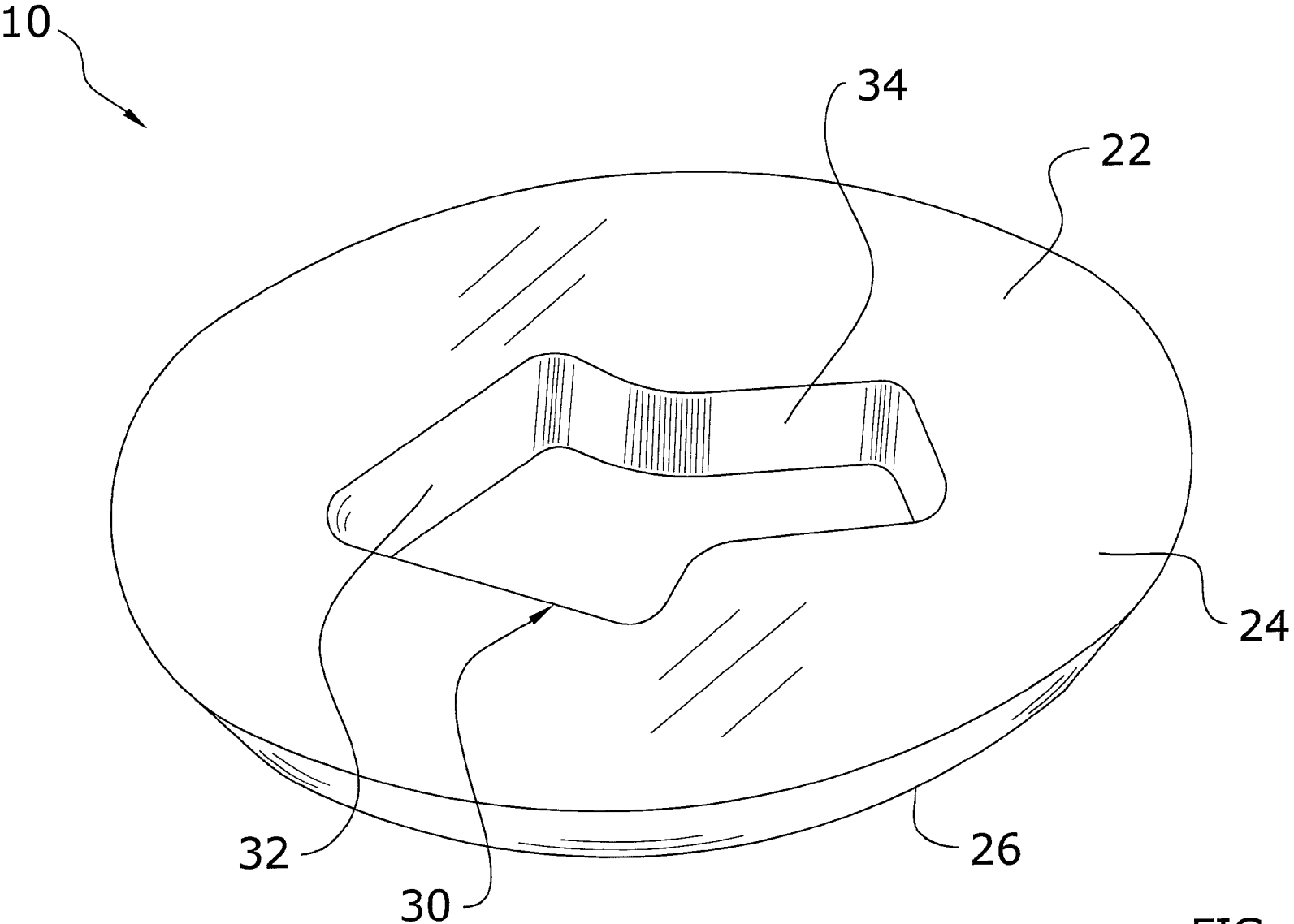
FIG. 1 is an upper perspective view of the present invention.
Figure 2:
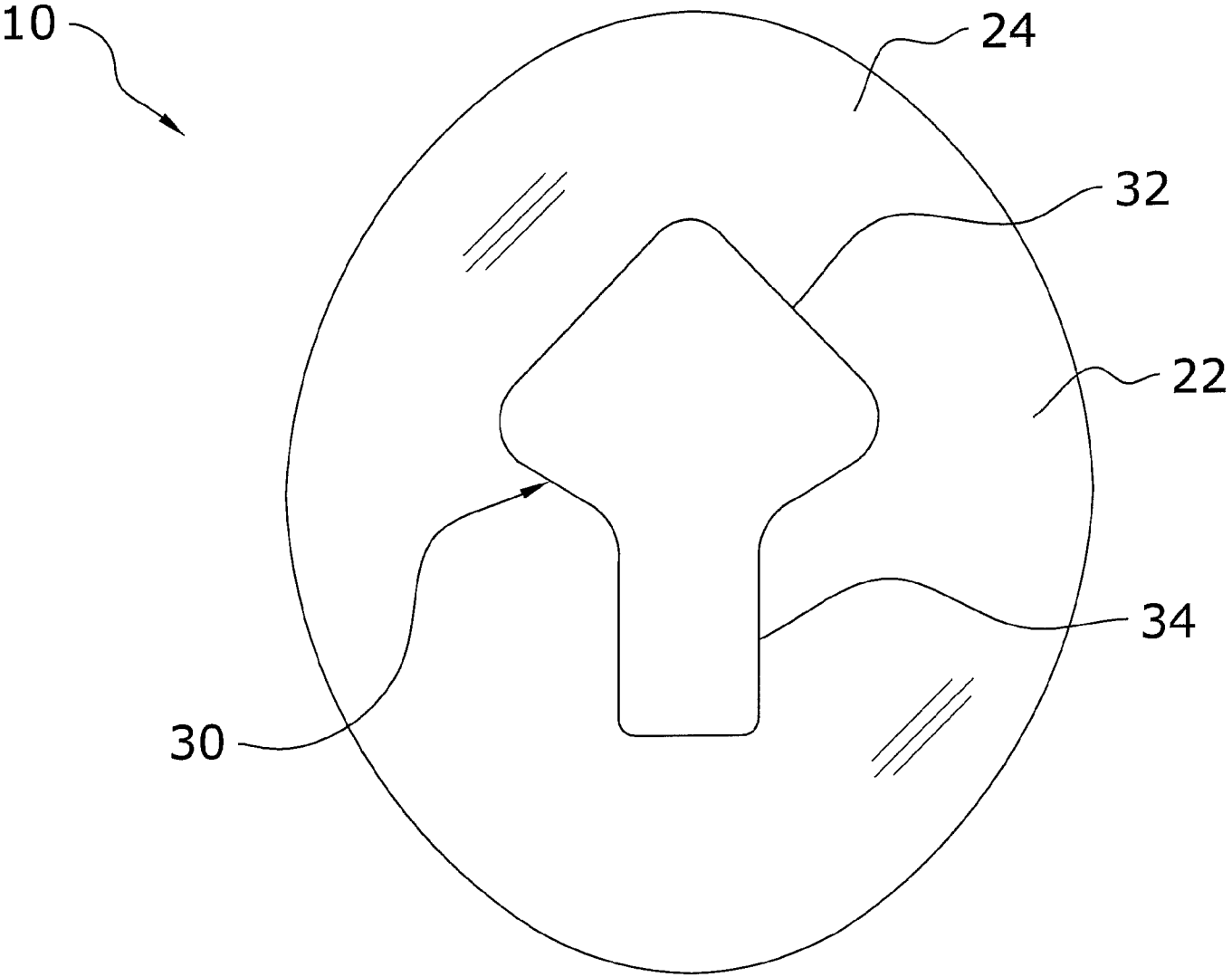
FIG. 2 is a top view of the present invention.
Figure 3:
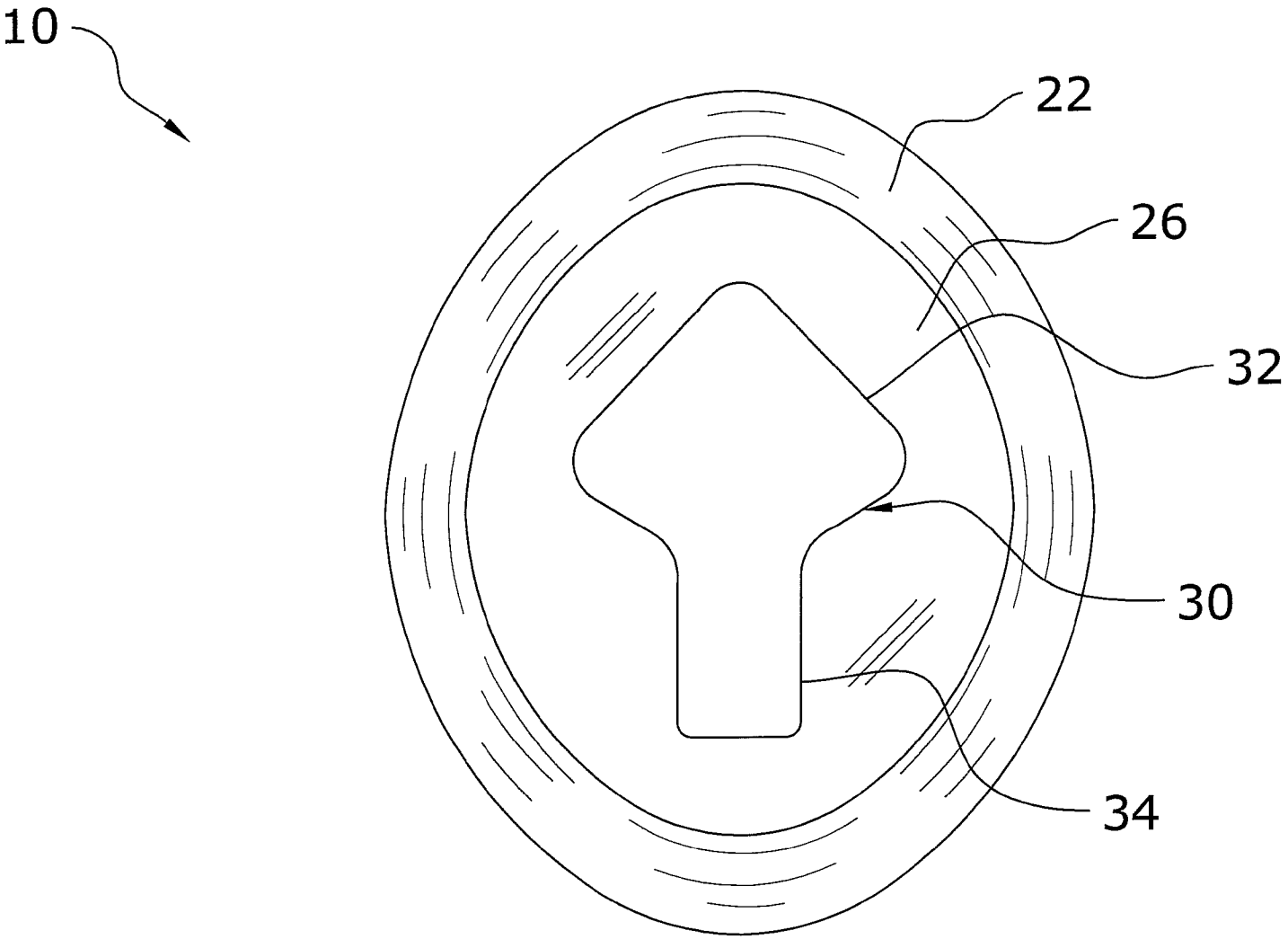
FIG. 3 is a bottom view of the present invention.

Turning now descriptively to the drawings, in which similar reference characters denote similar elements throughout the several views, FIGS. 1 through 7 illustrate a face cradle insert device 10, which comprises a pad 20 and a receiver opening 30, wherein the pad 20 is removably attached to a face cradle 14 of a massage table 12. The receiver opening 30 extends through the pad 20 and includes a first portion 32 and a second portion 34 extending from the first portion 32. The first portion 32 and the second portion 34 are comprised of a configuration to comfortably fit the face of a user.

The face cradle 14 preferably extends out from an end of the massage table 12. The face cradle 14 is preferably comprised of a horseshoe configuration; however other structures and configurations of face cradles 14 may be utilized during the use of the face cradle insert device 10. The face cradle 14 and the massage table 12 are also both preferably comprised of a standard face cradle 14 and massage table 12.

It is also appreciated that the face cradle insert device 10 may be utilized without the use of the face cradle 14. Also, the face cradle insert device 10 is preferably a separate device than the face cradle 14; however the face cradle insert device 10 may be integrally formed with the face cradle 14.

B. Pad

Figure 5:
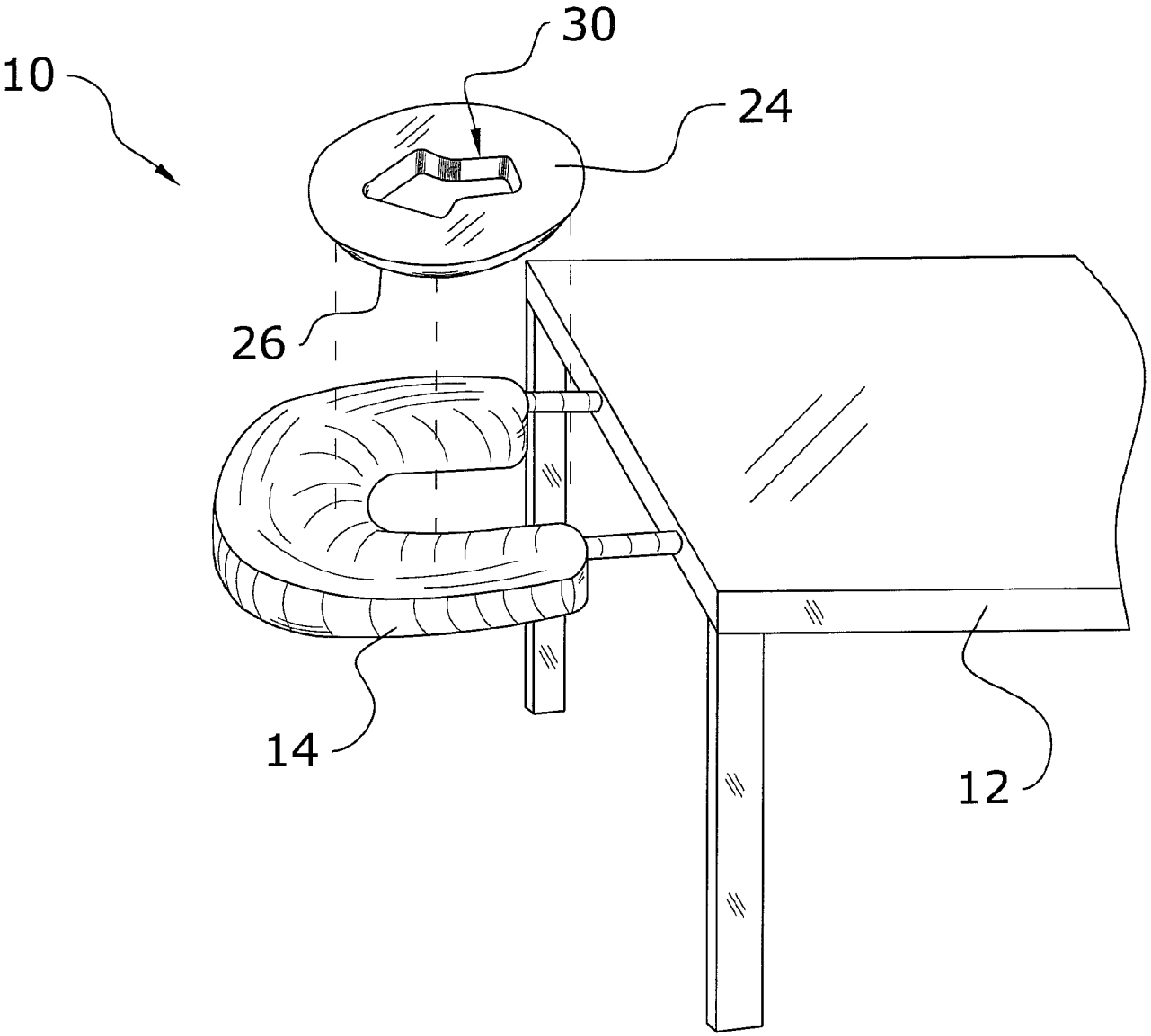
FIG. 5 is an upper perspective view of the present invention exploded from a massage table.
Figure 6:
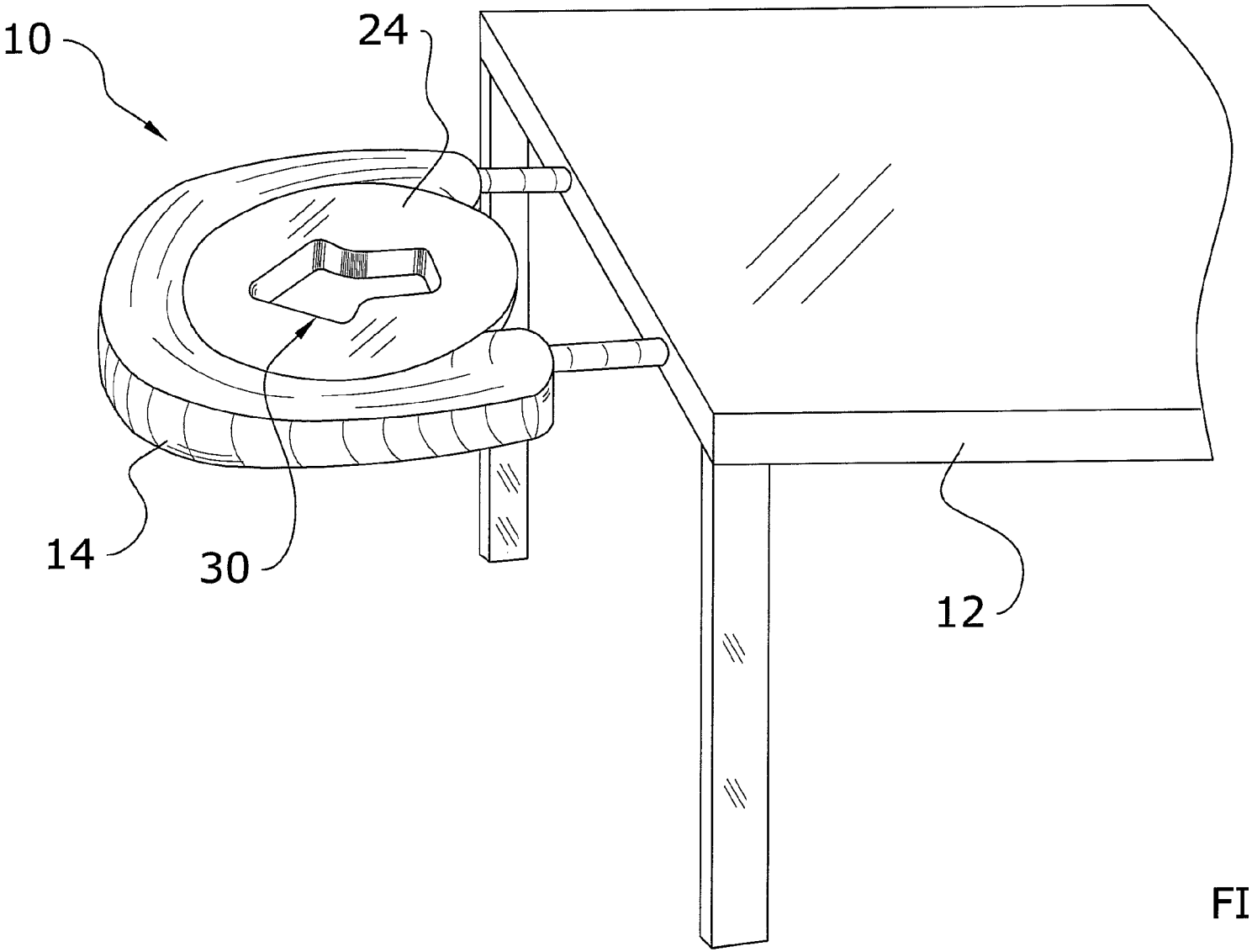
FIG. 6 is an upper perspective view of the present invention in use.

The pad 20 preferably fits within the face cradle 14 of the massage table 12 as illustrated in FIGS. 5 and 6. The pad 20 is preferably comprised of an oval shape to fit securely in the face cradle 12; however other shapes may be utilized in the construction of the pad 20. The pad 20 is also preferably comprised of a foam material. It is appreciated that the pad 20 may be comprised of a variety of materials other than the foam material. It is further appreciated that the face cradle insert device 10 may include a plurality of pads 20 stacked upon one another, rather than a single pad 20.

The pad 20 is preferably tapered vertically so as to be wedged into an opening of the face cradle 14 of the massage table 12. The pad 20 is preferably tapered in a manner that a perimeter of an upper side 24 of the pad 20 is greater than a perimeter of a lower side 26 of the pad 20 as shown in FIGS. 1 through 7. The perimeter of the upper side 24 of the pad 20 is also preferably greater than the perimeter of the opening of the face cradle 14 and the perimeter of the lower side 26 is preferably of a lesser distance than the perimeter of the opening of the face cradle 14 as illustrated in FIGS. 5 and 6.

Figure 4:
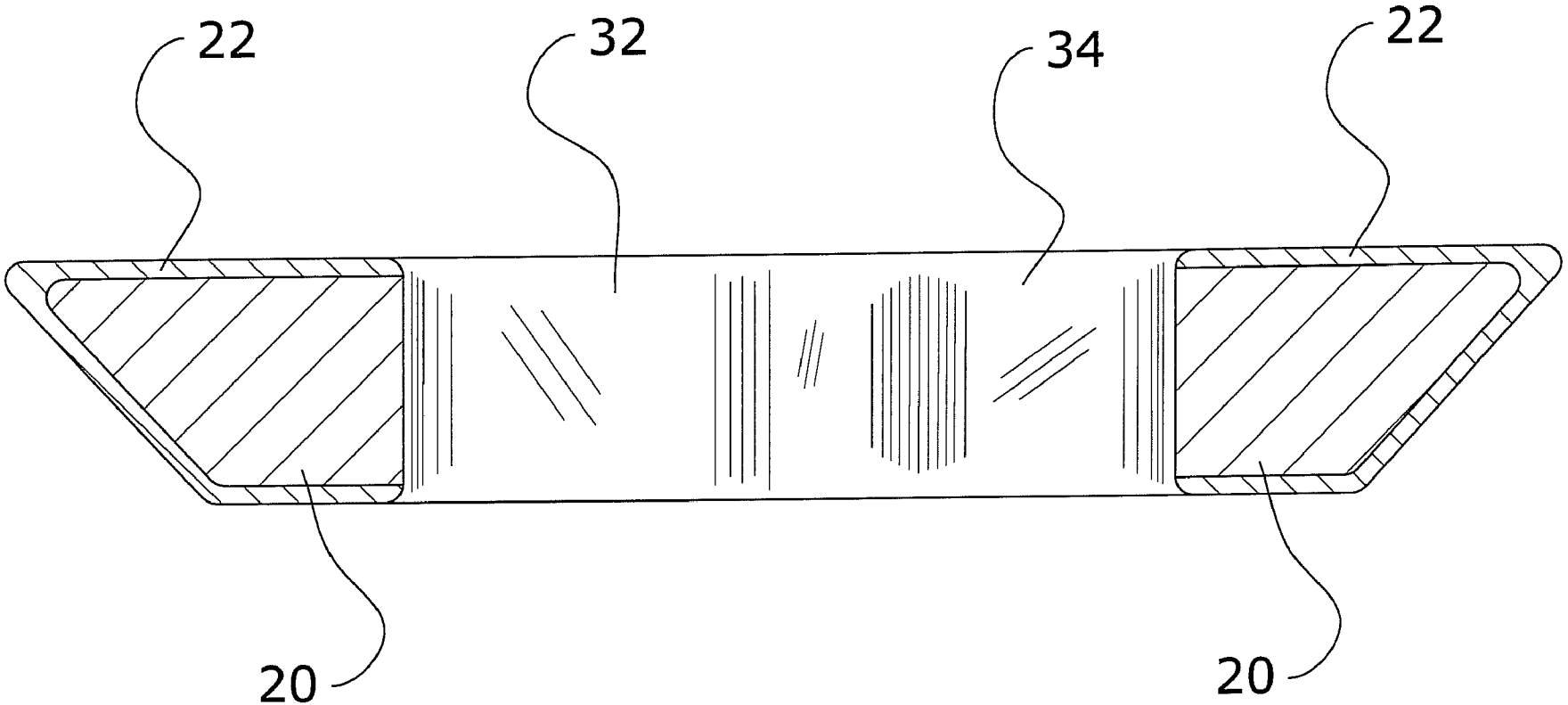
FIG. 4 is a cross-sectional view of the present invention.

The pad 20 also preferably includes a cover 22. The cover 22 preferably completely surrounds the pad 20 as shown in FIG. 4. The cover 22 also preferably surrounds the walls of the receiver opening 30. The cover 22 is also preferably comprised of a vinyl material; however other material may be utilized in the construction of the cover 22, such as but not limited to fleece and terry cloth. The cover 22 also may also be personalized to include various indicia and colors.

C. Receiver Opening

The receiver opening 30 is comprised of a configuration to promote easy breathing by the user while the user's face is against the upper side 24 or lower side 26 of the pad 20. The receiver opening 30 extends vertically through the pad 20. The receiver opening 30 preferably includes a first portion 32 and a second portion 34.

The second portion 34 of the receiver opening 30 preferably horizontally extends from the first portion 32 of the receiver opening 30 as illustrated in FIGS. 1 through 7. A centroid of the first portion 32 and a centroid of the second portion 34 also preferably align with a longitudinal center axis of the pad 20.

Figure 7:
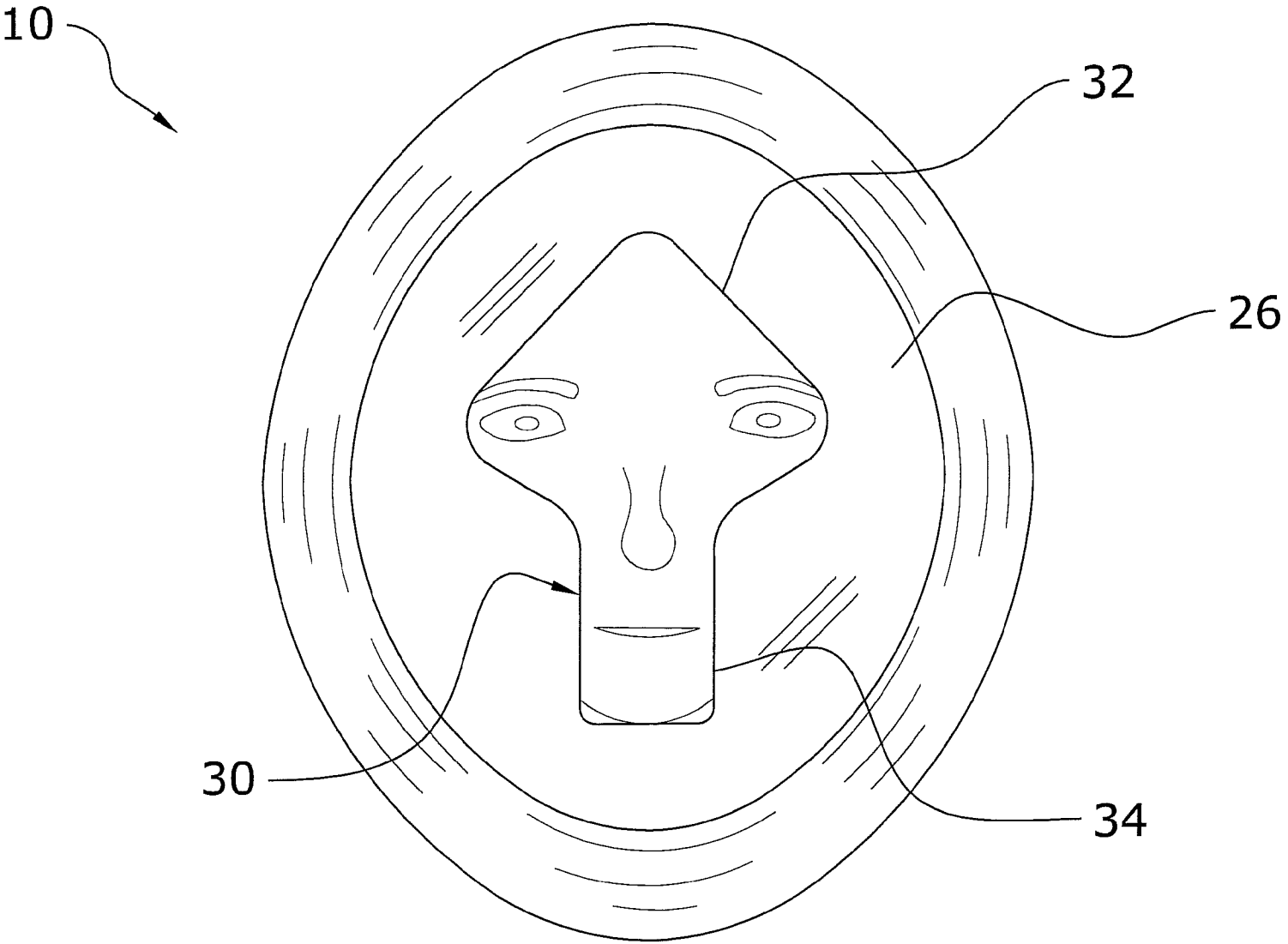
FIG. 7 is a bottom view of the present invention showing the preferred alignment of a face positioned within the present invention.

The first portion 32 of the receiver opening 30 is preferably substantially comprised of a triangular configuration as shown in FIGS. 1 through 7. The first portion 32 also preferably includes a plurality of corners. The latitudinal outer corners of the first portion 32 are preferably of a width great enough to receive the user's eyes so the user may see through the receiver opening 30 while the face cradle insert device 10 is in use as illustrated in FIG. 7. The corners of the first portion 32 are also preferably rounded so as to better conform to the contours of the user's face. It is appreciated that the first portion 32 may be comprised of other configurations, such as but not limited to a square, a rectangle or a circle.

The second portion 34 of the receiver opening 30 is preferably substantially comprised of a rectangular configuration as shown in FIGS. 1 through 7. The second portion 34 preferably extends substantially away from the first portion 32 to receive the user's chin as illustrated in FIG. 7. It is appreciated that the second portion 34 may be comprised of other configurations, such as but not limited to a square, a triangle or a circle.

D. In Use

In use, the face cradle insert device 10 is placed within the opening of the face cradle 14 of the massage table 12 so the lower side 26 of the face cradle insert device 10 is facing the floor. A downward force is applied to the pad 20 of the face cradle insert device 10 until the pad 20 is secure within the face cradle 14 of the massage table 12.

The user or patient then lies face down on the massage table 12 while placing their face over the receiver opening 30 of the pad 20. The user aligns with the receiver opening 30 so that the user's eyes are within the outer edges of the first portion 32 of the receiver opening 30 and the user's chin is positioned near a lower end of the second portion 34 of the receiver opening 30.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A face cradle insert device, comprising:

a massage table including a face cradle, wherein said face cradle horizontally extends from said massage table; and a pad including a receiver opening, wherein said pad is removably positioned within said face cradle of said massage table, and wherein said receiver opening extends through said pad;

wherein said receiver opening includes a first portion and a second portion contiguous to and substantially horizontally extending from said first portion, wherein said first portion is substantially comprised of a triangular configuration including at least one corner substantially aligned with a longitudinal axis of said pad to receive the forehead of a user;

wherein said first portion has a width great enough to receive the eyes of a user, wherein said second portion has a width less than said first portion and a length that is substantially parallel to the longitudinal axis of said pad in order to receive the user's chin.

2. The face cradle insert device of claim 1, wherein said second portion of said receiver opening is comprised of a substantially rectangular configuration.

3. The face cradle insert device of claim 1, wherein a centroid of said first portion and a centroid of said second portion align on a longitudinal center axis of said pad.

4. The face cradle insert device of claim 1, wherein said first portion includes a plurality of corners, wherein said plurality of corners are rounded.

5. The face cradle insert device of claim 1, wherein said pad is vertically tapered.

6. The face cradle insert device of claim 1, wherein said pad includes an upper side, wherein an outer perimeter of said upper side is greater than an inner diameter of said face cradle.

7. The face cradle insert device of claim 1, wherein said pad includes a lower side, wherein an outer perimeter of said lower side fits within an inner diameter of said face cradle.

8. The face cradle insert device of claim 1, wherein said pad is comprised of an oval shape.

9. The face cradle insert device of claim 1, wherein said pad is comprised of a foam material.

10. The face cradle insert device of claim 1, wherein said pad includes a cover, wherein said cover surrounds said pad.

11. The face cradle insert device of claim 10, wherein said cover is comprised of a vinyl material.

12. A face cradle insert device, comprising:

a massage table including a face cradle, wherein said face cradle horizontally extends from said massage table; and a pad including a receiver opening, an upper side and a lower side, wherein said pad is removably positioned within said face cradle of said massage table, and wherein said receiver opening extends through said pad;

wherein said receiver opening includes a first portion and a second portion contiguous to and substantially horizontally extending from said first portion, wherein said first portion of said receiver opening is substantially comprised of a triangular configuration including at least one corner substantially aligned with a longitudinal axis of said pad to receive the forehead of a user and wherein said second portion is comprised of a substantially rectangular configuration;

wherein said first portion has a width great enough to receive the eyes of a user, wherein said second portion has a width less than said first portion and a length that is substantially parallel to the longitudinal axis of said pad in order to receive the user's chin.

13. The face cradle insert device of claim 12, wherein said first portion includes a plurality of corners, wherein said plurality of corners are rounded.

14. The face cradle insert device of claim 12, wherein a centroid of said first portion and a centroid of said second portion align on a longitudinal center axis of said pad.

15. The face cradle insert device of claim 12, wherein said pad is comprised of an oval shape.

16. The face cradle insert device of claim 12, wherein said pad includes a cover, wherein said cover surrounds said pad.

17. A face cradle insert device, comprising:

a massage table including a face cradle, wherein said face cradle horizontally extends from said massage table;

a pad including a receiver opening, an upper side, a lower side, a first end and a second end, wherein said pad is removably positioned within said face cradle of said massage table;

wherein said pad is comprised of an oval shape;

wherein said pad is vertically tapered;

wherein an outer perimeter of said upper side of said pad is greater than an inner diameter of said face cradle and wherein an outer perimeter of said lower side of said pad fits within said inner diameter of said face cradle;

wherein said receiver opening includes a first portion and a second portion contiguous to and substantially horizontally extending from said first portion, wherein said receiver opening extends through said pad;

wherein said first portion of said receiver opening is substantially comprised of a triangular configuration including at least one corner substantially aligned with a longitudinal axis of said pad to receive the forehead of a user and wherein said second portion is comprised of a substantially rectangular configuration;

wherein said first portion includes a plurality of corners, wherein said plurality of corners are rounded;

wherein a centroid of said first portion and a centroid of said second portion align on a longitudinal center axis of said pad; and a cover to surround said pad;

wherein said first portion has a width great enough to receive the eyes of a user, wherein said second portion has a width less than said first portion and a length that is substantially parallel to the longitudinal axis of said pad in order to receive the user's chin.

18. The face cradle insert device of claim 17, wherein said pad is comprised of a foam material.

19. The face cradle insert device of claim 17, wherein said cover is comprised of a vinyl material.

* * * * *